US006196450B1

(12) United States Patent
Varadarajan et al.

(10) Patent No.: US 6,196,450 B1
(45) Date of Patent: Mar. 6, 2001

(54) EASY-OPEN COMPOSITE CONTAINER WITH A MEMBRANE-TYPE CLOSURE

(75) Inventors: Krishnaraju Varadarajan, Florence, SC (US); Michael T. Drummond, Laurinburg, NC (US); Alan D. Williams, Camden, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/388,897

(22) Filed: Sep. 2, 1999

(51) Int. Cl.[7] ..... B65D 5/64
(52) U.S. Cl. ..... 229/123.2; 229/5.5; 220/359.3
(58) Field of Search ..... 229/123.2, 5.5; 220/359.2, 359.3, 359.4

(56) References Cited

U.S. PATENT DOCUMENTS

| | | | | |
|---|---|---|---|---|
| 2,937,481 | | 5/1960 | Palmer . | |
| 3,460,310 | | 8/1969 | Adcock et al. . | |
| 3,501,045 | | 3/1970 | Asmus et al. . | |
| 3,734,044 | | 5/1973 | Asmus et al. . | |
| 3,767,076 | | 10/1973 | Kennedy . | |
| 3,805,993 | | 4/1974 | Enzie et al. . | |
| 3,808,074 | | 4/1974 | Smith et al. . | |
| 3,892,351 | | 7/1975 | Johnson et al. . | |
| 3,973,719 | | 8/1976 | Johnson et al. . | |
| 4,196,841 | | 4/1980 | Smith et al. . | |
| 4,280,653 | | 7/1981 | Elias . | |
| 4,557,414 | * | 12/1985 | Ford et al. | 229/5.5 |
| 4,693,390 | * | 9/1987 | Hekal | 229/123.2 |
| 4,858,780 | * | 8/1989 | Odaka et al. | 220/359.2 |
| 4,865,217 | | 9/1989 | Yoshimoto . | |
| 5,178,293 | | 1/1993 | Suzuki et al. . | |
| 5,240,133 | * | 8/1993 | Thomas, Jr. | 220/359.3 |
| 5,829,669 | | 11/1998 | Drummond et al. . | |
| 5,846,619 | | 12/1998 | Cahill et al. . | |
| 5,979,748 | * | 11/1999 | Drummond et al. | 229/5.5 |

* cited by examiner

*Primary Examiner*—Gary E. Elkins
(74) *Attorney, Agent, or Firm*—Alston & Bird LLP

(57) ABSTRACT

An easy-open composite container has a membrane-type closure and includes a laminated tubular body member of composite materials having a predetermined laminated strength. The body member includes a bodywall portion and a liner portion positioned inside the bodywall portion and forming an inside surface of the body member. An outwardly-rolled rim portion is formed at the upper area of an open upper end of the tubular body member and the liner portion forms a top surface of the body member open upper end and an outside surface of the outwardly rolled rim portion. A cut extends circumferentially around a segment of the outside surface of the rim portion and extends radially-inwardly through at least a part of the liner portion. A membrane closure covers the open upper end of the body member and has an outwardly extending tab portion positioned over the cut in the rim portion of the body member. A bond is formed between the top surface of the body member open upper end and the membrane member for hermetically closing such open upper end. This bond has a predetermined strength greater than the laminated strength of the tubular body member and sufficient to prevent leakage caused by internal pressure within the container. With the above construction, the composite container can be easily opened by pulling the pull tab portion of the membrane closure member which causes radial delamination of a segment of the body member rim portion at the cut in the rim portion to provide an easy start for removing the membrane member with the delaminated rim portion segment from the remainder of the body member rim portion of the container.

8 Claims, 2 Drawing Sheets

EASY-OPEN COMPOSITE CONTAINER WITH A MEMBRANE-TYPE CLOSURE

FIELD OF THE INVENTION

This invention relates to a composite container having a membrane-type closure on one end thereof which provides sufficient strength to withstand internal pressure while being easily opened without tearing the membrane during such opening.

BACKGROUND OF THE INVENTION

Composite containers (usually spirally wound) are used for packaging a wide variety of products including food products, such as PRINGLES® potato chips. These composite containers typically have a metal end seamed onto the container on a lower end thereof and a membrane bonded to the upper end of the composite container which usually has an outwardly turned flange on the upper end for receiving the membrane.

The bond between the membrane and the outwardly turned flanged upper end of the composite container, as well as the metal end seamed lower end of the composite container, must be hermetic and have a strength sufficient to withstand high internal pressures developed inside the container at high altitudes and/or temperature after being packaged with a food product or the like. The bond between the membrane and the flanged upper end of the composite container must also be weak enough to be opened easily without tearing the membrane during the opening. These opposed structural characteristics have presented problems in either having a membrane to container bond which is too weak to withstand the internal pressures developed at high altitudes and/or temperatures or too strong to provide easy-opening without tearing the membrane.

OBJECT AND SUMMARY OF THE INVENTION

Accordingly, it is the object of this invention to provide an easy-open composite container having a membrane-type closure which provides a bond between the membrane closure and the container body member which is strong enough to withstand very high pressure developed inside the container at high altitudes and/or temperatures and is weak enough to allow easy-opening without tearing of the membrane closure.

By this invention, it has been found that the above object may be accomplished by providing an easy-open composite container having a membrane-type closure and comprising the following.

A laminated tubular body member of composite materials (preferably of a spirally-wound construction) having a predetermined laminated strength (preferably laminated with a suitable adhesive) and defining inside and outside surfaces and an open upper end. The body member includes a body wall portion and a liner portion positioned inside the body wall portion and forming the body member inside surface. An outwardly-rolled rim portion is formed at an upper area of the open upper end of the tubular body member and the liner portion forms a top surface of the body member open upper end and an outside surface of the outwardly-rolled rim portion. A cut extends circumferentially around a segment of the outside surface of the rim portion and extends radially-inwardly through at least a part of the liner portion.

A membrane closure member of substantially a shape corresponding to the body member open upper end has a pull tab portion extending outwardly from an outer circumferential area thereof. The membrane closure member is positioned on the top surface of the body member open upper end with the pull tab portion over the cut in the rim portion. A bond (preferably a heat seal) is formed between the top surface of the body member open upper end and the membrane member for hermetically closing the open upper end. The bond has a predetermined strength greater than the laminated strength of the tubular body member and sufficient to prevent leakage caused by internal pressure within the container.

The above defined composite container can be easily opened by pulling the pull tab portion of the membrane closure member which causes radial delamination of a segment of the body member at the cut in the rim portion to provide an easy start for removing the membrane member with the segment delaminated rim portion from the remainder of the body member rim portion.

BRIEF DESCRIPTION OF THE DRAWINGS

Some of the objects and advantages of this invention have been described above, other objects and advantages will become apparent from the detailed description of the preferred embodiment of this invention below when taken in conjunction with the accompanying drawings, in which.

DETAILED DESCRIPTION OF PREFERRED EMBODIMENT OF THE INVENTION

Figure 1:
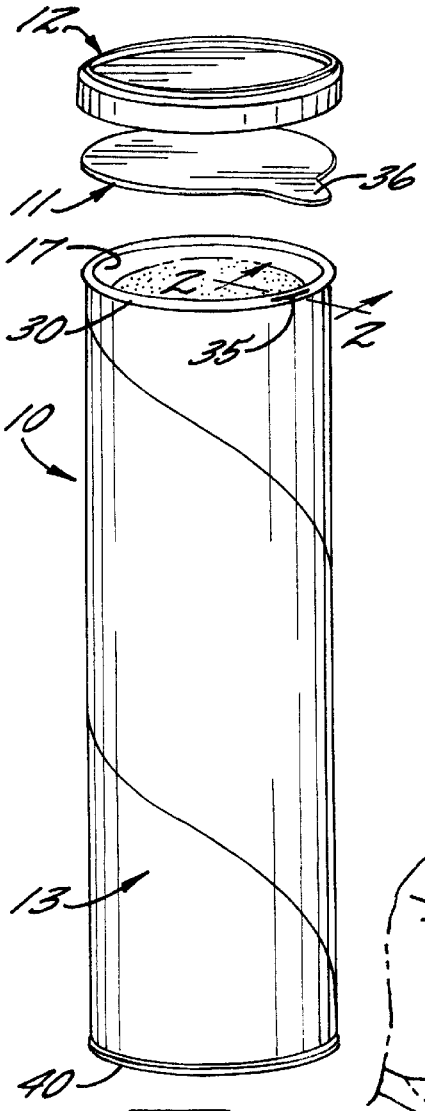
FIG. 1 is an exploded perspective view of an easy-open composite container having a membrane type closure and overcap and constructed in accordance with this invention.

The present invention will now be described more fully hereinafter with reference to the accompanying drawings in which a preferred embodiment of the invention is shown. This invention may, however, be embodied in many different forms and should not be construed as limited to the embodiment set forth herein; rather, this embodiment is provided so that the disclosure will be thorough and complete and will fully convey the scope of the invention to those skilled in the art. Like reference numerals refer to like elements throughout.

An easy-open composite container 10 with a membrane-type closure 11 and constructed in accordance with the present invention is illustrated in FIG. 1. Although illustrated as having a circular cross-section, the container 10 may have any cross-sectional shape which could incorporate the novel features of this invention, to be described below. One other example is a generally rectangular shaped container having rounded corners.

Figure 2:
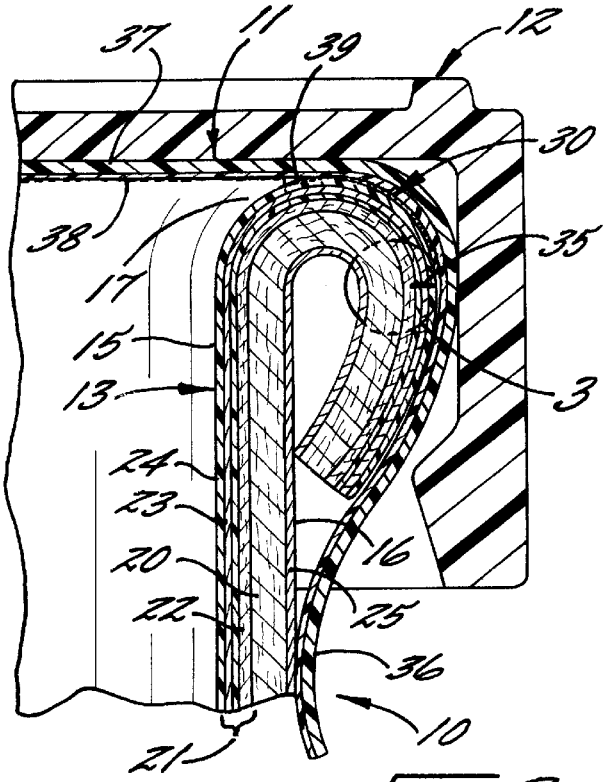
FIG. 2 is an enlarged sectional view taken generally along the line 2—2 of FIG. 1 and through the upper end of the composite container with the membrane and overcap in a non-exploded position.

The type of easy-open composite container illustrated in FIG. 1 is particularly advantageous for packaging food products, such as PRINGLES® potato chips, which typically includes the membrane type closure 11 and a reusable plastic end cap 12 positioned over the membrane closure 11 prior to opening of the container (as shown in FIG. 2). The easy-open composite container 10 includes a laminated tubular body member 13 constructed of composite materials and having a predetermined laminated strength and defining inside and outside surfaces 15, 16 and an open upper end 17.

As shown in more detail in FIG. 2, the body member 13 includes a bodywall portion 20 and a liner portion 21 positioned inside the bodywall portion 20 and forming the body member inside surface 15. The bodywall portion 20 comprises a relatively thick and stiff paperboard ply well known to those with ordinary skill in the art. The liner layer portion 21 preferably comprises a Kraft paper ply 22 laminated to the paperboard ply 20 and a foil ply 23 of aluminum or other suitable material for providing strength and barrier properties to the liner. The liner layer portion 21 also includes an inside polymer coating 24 which forms the inside surface 15 of the tubular body member 13. The Kraft paper liner ply 22 and the foil liner ply 23 may be laminated to each other and to the paperboard body ply 20 by suitable adhesive such as PVA (polyvinyl acetate) to provide a desired laminated strength which preferably is between about 0.5 lb./in. and 12 lb./in. The tubular body member 13 may also include a label portion 25 laminated to the outside of the bodywall portion 20 by suitable adhesives or the like and forming the outside surface 16. The bodywall portion 20, the liner portion 21 and the label portion 25 may all be spirally wound and laminated together to form a spirally wound tubular construction in a manner well understood by those with ordinary skill in the art and which, for example, is more fully disclosed in assignee's recently issued U.S. Pat. No. 5,846,619 (the disclosure of which is incorporated herein by reference).

Figure 3:
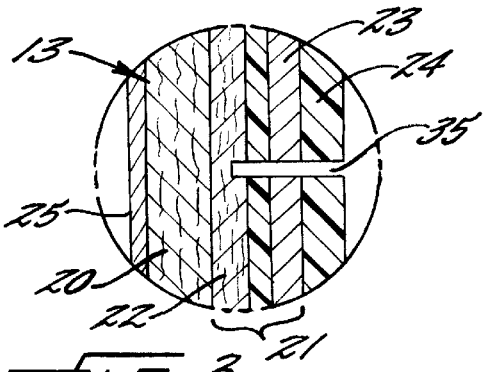
FIG. 3 is a further enlarged sectional detail taken within the circle 3 of FIG. 2 and illustrating the cut extending radially inwardly of the outwardly rolled rim portion of the upper end of the tubular body member.
Figure 4:
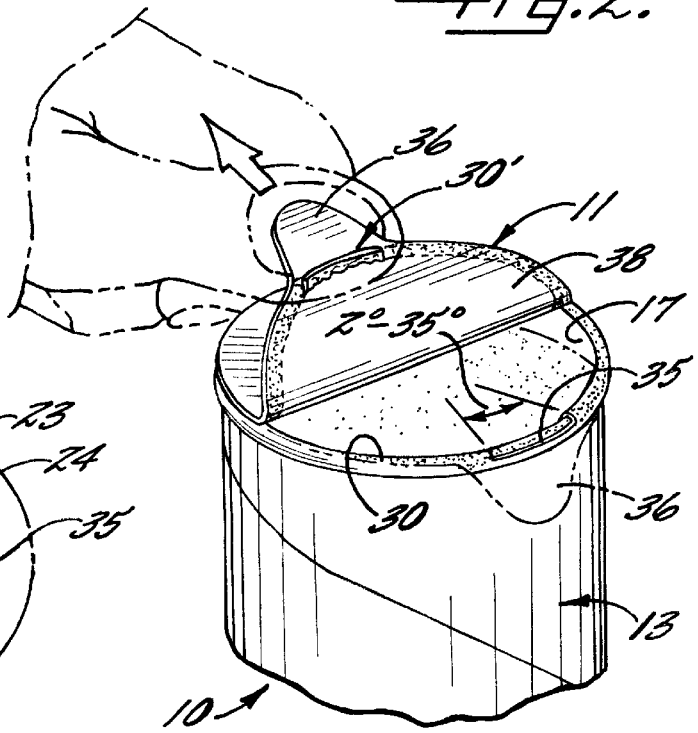
FIG. 4 is a partial perspective view of the upper end of the easy-open composite container showing the membrane closure being removed therefrom.

The laminated tubular body member 13 of composite materials includes an outwardly-rolled rim portion 30 formed at an upper area of the open upper end 17. The liner portion 21 forms a top surface of the body member open upper end 17 and an outside surface of the outwardly-rolled rim portion 30 (as may be clearly seen in FIG. 2). A cut 35 extends circumferentially around a segment of the outside surface of the rim portion 30 and extends radially-inwardly through at least a part of the liner portion 21 (as may be seen in FIGS. 2 and 3). Preferably, the cut 35 extends radially inwardly of the rim portion 30 through the polymer coating 24, the foil ply 23 and at least partially through the Kraft paper ply 22 of the liner portion 21. The cut 35 preferably extends circumferentially around a segment of the outside surface of the rim portion of between 2° and 35° (as indicated in FIG. 4).

The membrane closure member 11 is of substantially a shape corresponding to the body member open upper end 17 and has a pull tab portion 36 extending-outwardly from an outer circumferential area thereof. The membrane closure member 11 is positioned on the top surface of the body member open upper end 17 which is formed by the polymer coating 24 of the liner layer portion 21 and the membrane pull tab portion 36 is positioned over the cut 35 in the rim portion 30 of the tubular body member 13. The membrane closure member 11 may include a foil ply (aluminum or the like) 37 and an inside polymer coating 38 (as shown in FIG. 2).

A bond (which may be a heat sealed bond) is formed between the top surface of the body member open upper end 17 (constituted by the polymer coating 24 of the liner layer portion 21) and the inside surface of the membrane closure member 11 (constituted by the polymer coating 38) for hermetically closing the open upper end 17 of the body member 13 of the container 10. This bond, indicated at 39 in FIG. 2, has a predetermined strength greater than the laminated strength of the tubular body member and sufficient to prevent leakage caused by internal pressure within the container 10. This predetermined bond strength is preferably between about 1 lb./in. and 15 lb./in.

The lower end of the tubular body member 13 of the container 10 may be closed by any suitable closure 40 (crimped metal end or the like) to maintain the hermetic closing of the container 10.

Figure 5:
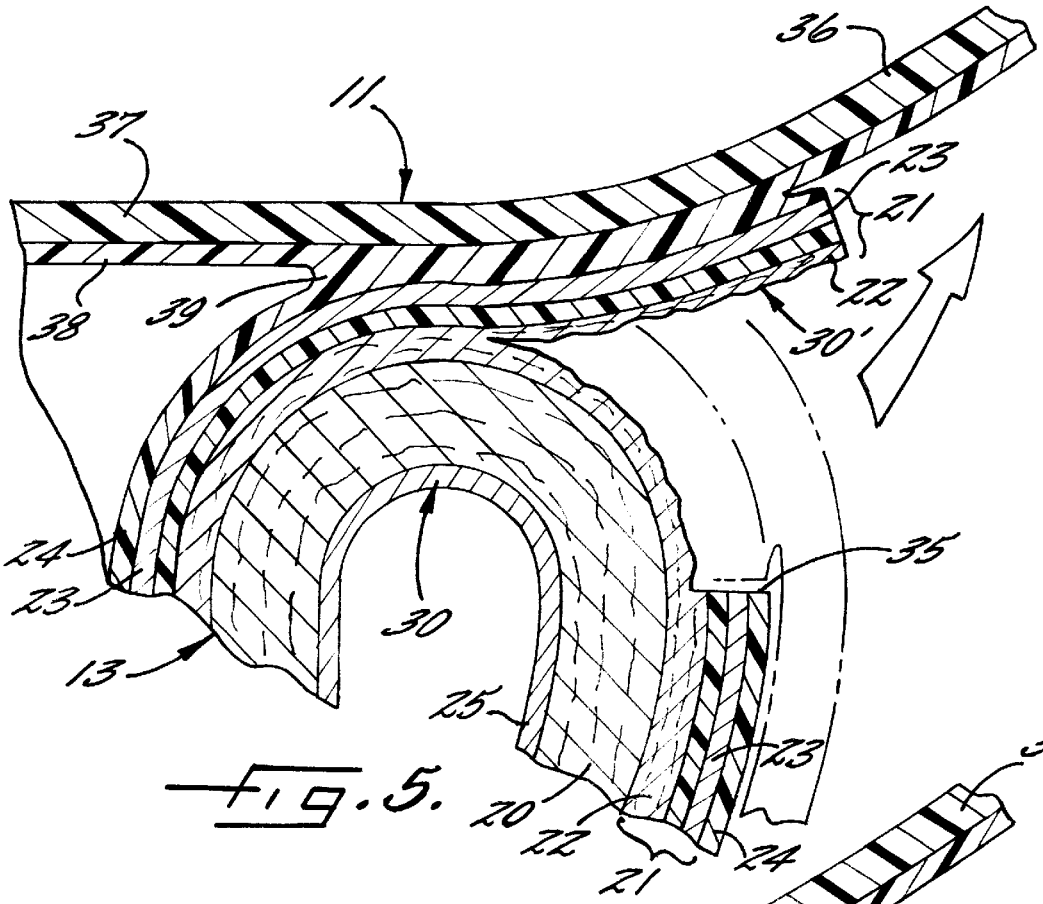
FIGS. 5 and 6 are greatly enlarged sectional schematic views through a portion of the upper end of the easy-open composite container showing progressive steps of the membrane being easily removed from the composite container.
Figure 6:
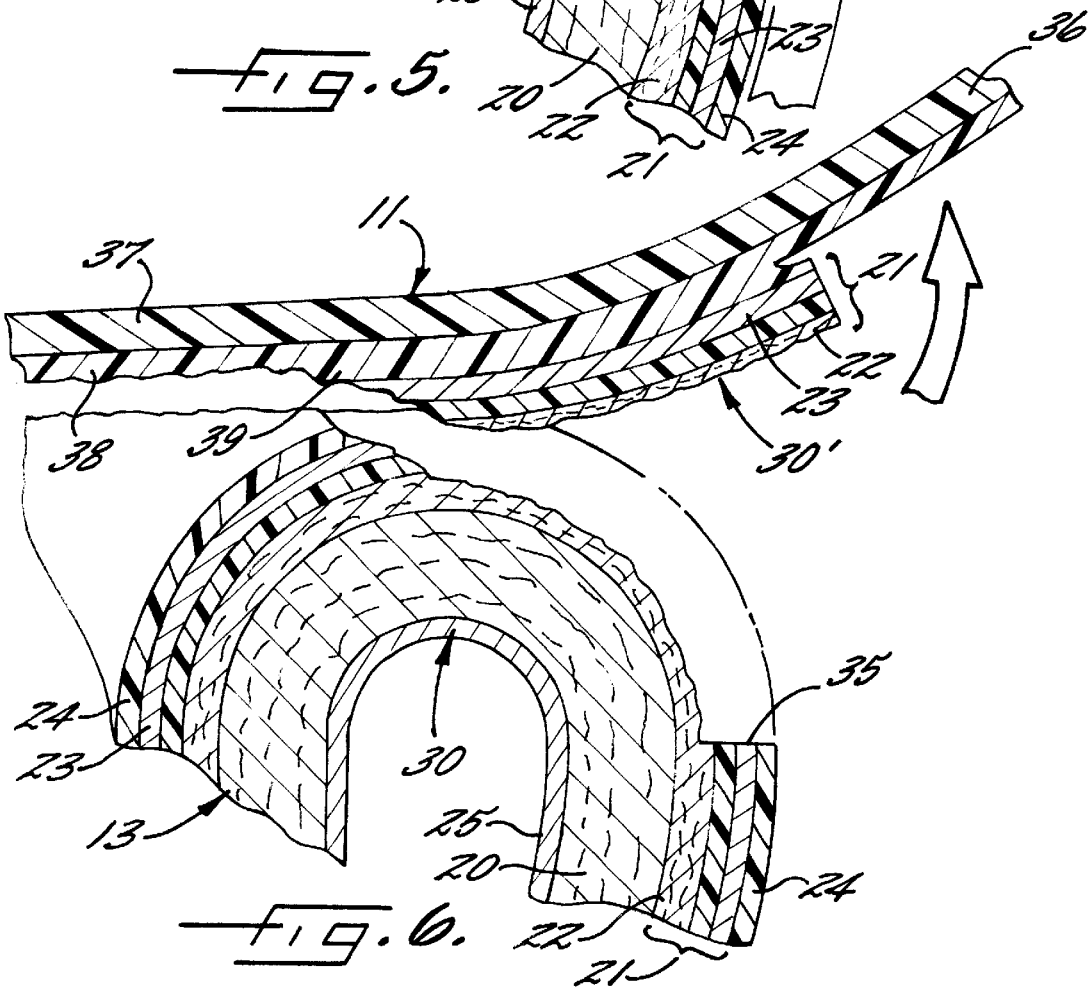

With the above defined construction of the composite container 10 and membrane type closure 11, the container 10 can be easily opened by removing the cap 12 and by pulling the pull tab portion 36 of the membrane closure member 11 which causes radial delamination of a segment 30' of the rim portion 30 of the body member 13 at the cut 35 (as shown in FIGS. 5 and 6) to provide an easy start for removing the membrane member 11 with the delaminated rim portion segment 30' from the remainder of the rim portion 30 of the body member 13 of the container 10 (as shown in FIG. 4 and 6).

Thus, an easy-open composite container 10 having a membrane type closure 11 has been provided which has a bond 39 between the membrane closure 11 and the body member 13 which is strong enough to withstand very high pressure developed inside the container after packaging with food products or the like and at high altitudes and/or temperatures, but which is weak enough to allow easy opening of the container 10 without tearing of the membrane closure member 11.

Many modifications and other embodiments of the invention will come to mind to one skilled in the art to which this invention pertains and having the benefit of the teachings presented in the foregoing description and associated drawings. Therefore, it is to be understood that the invention is not to be limited to the specific embodiment disclosed and other embodiments are intended to be included within the scope of the appended claims. In addition, although the composite container according to the present invention has been described primarily in connection with food products, it is to be understood that the container of this invention could be used in connection with other products. Although specific terms are employed in the detailed description above, they are used in a generic and descriptive sense and not for purposes of limitation.

What is claimed is:

1. An easy-open composite container having a membrane-type closure and comprising:

a laminated tubular body member of composite materials having a predetermined laminated strength and defining inside and outside surfaces and an open upper end, said body member including a body wall portion and a liner portion positioned inside said body wall portion and forming said body member inside surface;

an outwardly-rolled rim portion formed at an upper area of said open upper end of said tubular body member and wherein said liner portion forms a top surface of said body member open upper end and an outside surface of said outwardly-rolled rim portion;

a cut extending circumferentially around a segment of said outside surface of said rim portion and extending radially-inwardly through at least a part of said liner portion;

a membrane closure member of substantially a shape corresponding to said body member open upper end and having a pull tab portion extending-outwardly from an outer circumferential area thereof, said membrane closure member being positioned on said top surface of said body member open upper end with said pull tab portion over said cut in said rim portion; and a bond between said top surface of said body member open upper end and said membrane member for hermetically closing said open upper end, said bond having a predetermined strength greater than laminated strength of said tubular body member and sufficient to prevent leakage caused by internal pressure within said container;

whereby, said composite container can be easily opened by pulling said pull tab portion of said membrane closure member which causes radial delamination a segment of said rim portion of said body member at said cut segment to provide an easy start for removing said membrane member with the delaminated rim portion segment from the remainder of said body member rim portion.

2. An easy-open composite container having a membrane-type closure, as set forth in claim 1, in which said laminated tubular body member of composite materials comprises a spirally-wound construction and further includes an adhesive between said bodywall portion and said liner portion providing a laminating strength of between 0.5 lb./in. and 12 lb./in.; and in which said bond between said top surface of said body member open upper end and said membrane member comprises a heat seal providing a bond strength of between 1 lb./in. and 15 lb./in.

3. An easy-open composite container having a membrane-type closure, as set forth in claim 1 or 2, in which said tubular body member bodywall portion comprises a paperboard ply, and said tubular body member liner portion comprises a Kraft paper ply laminated to said paperboard ply and a foil ply laminated to said Kraft paper ply and having an inside polymer coating to effect said bond between said body member open upper end and said membrane closure member.

4. An easy-open composite container having a membrane-type closure, as set forth in claim 3, in which said membrane closure member comprises a foil ply and an inside polymer coating to effect said bond between said body member open upper end and said membrane closure member.

5. An easy-open composite container having a membrane-type closure, as set forth in claim 3, in which said cut extends radially inwardly of said rim portion through said polymer coating, said foil ply and at least partially through said Kraft paper ply of said tubular body member liner portion.

6. An easy-open composite container having a membrane-type closure, as set forth in claim 3, in which said cut extends circumferentially around a segment of said outside surface of said rim portion of between 2° and 35°.

7. An easy-open composite container having a membrane-type closure, as set forth in claim 3, in which said cut extends radially inwardly of said rim portion through said polymer coating, said foil ply and at least partially through said Kraft paper ply of said tubular body member liner portion, and in which said cut extends circumferentially around a segment of said outside surface of said rim portion of between 2° and 35°.

8. An easy-open composite container having a membrane-type closure and comprising a spirally-wound laminated tubular body member of composite materials defining inside and outside surfaces and an open upper end, said body member including a bodywall portion comprising a paperboard ply, a liner portion positioned inside said bodywall portion and forming said body member inside surface and comprising a Kraft paper ply laminated to said paperboard ply and a foil ply laminated to said Kraft paper ply and having an inside polymer coating defining said body member inside surface, and an adhesive between said bodywall portion and said liner portion providing a laminated strength of between 0.5 lb./in. and 12 lb./in.;

an outwardly-rolled rim portion formed at an upper end of said open upper end of said tubular body member and wherein said polymer coating of said liner portion forms a top surface of said body member open upper end and an outside surface of said outwardly-rolled rim portion;

a cut extending circumferentially around a segment of between 2° and 35° of said outside surface of said rim portion and extending radially inwardly through said polymer coating, said foil ply and at least partially through said Kraft paper ply of said tubular body member liner portion;

a membrane closure member comprising a foil ply and an inside polymer coating and being of substantially a shape corresponding to said body member open upper end and having a pull tab portion extending outwardly from an outer circumferential area thereof, said membrane closure member being positioned with said inside polymer coating on said top polymer surface of said body member open upper end and with said pull tab portion over said cut in said rim portion; and a bond between said top surface of said body member open upper end and said membrane member comprising a heat seal between said polymer coating on said tubular body liner portion and said polymer coating on said membrane closure member for hermetically closing said open upper end of said tubular body member, said bond having a predetermined strength of between 1 lb./in. and 15 lb./in. which is greater than the laminated strength of said tubular body member and sufficient to prevent leakage caused by internal pressure within said container;

whereby said composite container can be easily opened by pulling said pull tab portion of said membrane closure member which causes radial delamination of said body member at said cut segment of said rim portion to provide an easy start for removing said membrane member with the delaminated rim portion from the remainder of said body member rim portion.

* * * * *